US008340805B2

(12) United States Patent
Zenoni et al.

(10) Patent No.: US 8,340,805 B2
(45) Date of Patent: Dec. 25, 2012

(54) METHOD AND APPARATUS FOR DETECTING ACCIDENTAL STOPS OF THE YARN ON A KNITTING LINE

(75) Inventors: Pietro Zenoni, Leffe (IT); Giovanni Pedrini, Leffe (IT); Luca Gotti, Albino (IT)

(73) Assignee: L.G.L. Electronics S.p.A., Gandino (IT)

( * ) Notice: Subject to any disclaimer, the term of this patent is extended or adjusted under 35 U.S.C. 154(b) by 37 days.

(21) Appl. No.: 13/067,668

(22) Filed: Jun. 20, 2011

(65) Prior Publication Data

US 2012/0031148 A1 Feb. 9, 2012

(30) Foreign Application Priority Data

Aug. 4, 2010 (EP) ..... 10425268

(51) Int. Cl.
*G06F 19/00* (2006.01)

(52) U.S. Cl. ..... 700/141; 66/158; 66/163

(58) Field of Classification Search ..... 66/157, 66/158, 160, 161, 163, 165, 166, 167; 700/140, 700/141, 143
See application file for complete search history.

(56) References Cited

U.S. PATENT DOCUMENTS 4,259,852 A 4/1981 Jacobsson
5,285,821 A * 2/1994 Fredriksson ..... 139/452
5,838,570 A * 11/1998 Barea ..... 700/143
6,328,081 B1 * 12/2001 Gotti et al. ..... 139/450
6,999,837 B2 * 2/2006 Rundberg et al. ..... 700/143
7,110,846 B2 * 9/2006 Hellstroem et al. ..... 700/130
7,337,036 B2 * 2/2008 Pedrini et al. ..... 700/141
7,584,014 B2 * 9/2009 Gotti et al. ..... 700/140
8,086,342 B2 * 12/2011 Gotti et al. ..... 700/140
2005/0026507 A1 2/2005 Pedrini et al.
2009/0057464 A1 3/2009 Gotti et al.

* cited by examiner

*Primary Examiner* — Danny Worrell
(74) *Attorney, Agent, or Firm* — Modiano & Associati; Albert Josif; Daniel J. O'Byrne

(57) ABSTRACT

A knitting line comprises a plurality of yarn feeders from which a downstream machine draws respective yarns. The machine is provided with selection elements adapted to vary the state of selection of the yarn feeders in relation to the angular position of the machine. Each of the yarn feeders is provided with a stationary drum and with a yarn count sensor arranged to generate a pulse per each yarn loop unwound from the drum. A selection signal is periodically sent to the yarn feeders, which is indicative of the state of selection of the individual feeders in relation to the angular position of the machine. For each of the selected feeders, a threshold time interval is continuously calculated, which corresponds to the maximum interval between two successive pulses, above which it should be regarded that an accidental stop of the yarn has occurred, and is updated in real time as a function of the yarn-drawing speed, the delay from the last pulse is continuously measured and compared with the updated threshold time interval, and the downstream machine is stopped when the measured delay exceeds the updated threshold interval.

9 Claims, 2 Drawing Sheets

METHOD AND APPARATUS FOR DETECTING ACCIDENTAL STOPS OF THE YARN ON A KNITTING LINE

The present invention relates to a method for detecting accidental stops of the yarn on a knitting line and to an apparatus for carrying out the method.

BACKGROUND OF THE INVENTION

As known, the knitting lines typically comprise a plurality of yarn feeders each provided with a stationary drum on which a motorized flywheel winds a plurality of yarn loops forming a weft stock. Upon request from a downstream machine, typically a circular/rectilinear knitting machine of a conventional type, the loops are unwound from the drum, then pass through a weft-braking device which controls the tension of the yarn, and finally are fed to the machine.

The yarn feeders of the above type are well-known to the person skilled in the art and have the main scope of maintaining the amount of yarn stored on the drum substantially constant irrespective of the yarn-drawing speed of the machine, while minimizing the tension of the unwinding yarn. To this purpose, the yarn feeder is provided with various sensors, one of which is a loop count sensor, such as an optical sensor, a piezoelectric sensor, and the like, which generates at least one pulse per each unwound loop. This sensor cooperates with the other sensors to optimize the yarn-winding speed of the flywheel, in such a way as to stabilize the amount of yarn stored on the drum.

In the conventional systems, another sensor is arranged between the feeder and the knitting machine for detecting any accidental stops of the yarn, which circumstance may occur in case of breaking of the yarn or unhooking of the yarn from the needles of the machine. In these cases, the control unit stops the machine in order to safeguard the finished article from defects and to prevent the weft tube of the article under processing from detaching, which circumstance, as known, requires a laborious, time-consuming operation of re-inserting all the yarns forming the article into the machine.

As known, the above yarn-breaking sensors may be either mechanical or electronic.

The mechanical sensors have the advantage of being less expensive, but they are also less effective in terms of quickness of response; moreover, they are provided with a sensing arm which grazes the yarn in operation, thereby interfering with the yarn-feeding tension and consequently affecting the accuracy of the tension control system.

The electronic sensors have the advantage of being more effective in terms of quickness of response and, in operation, they do not interfere with the tension of the unwinding yarn because the motion of the yarn is detected by a photoelectric sensor. However, the electronic sensors are very expensive and they require the installation and wiring of an additional supplying/communication circuit, with consequent rise both in costs and in the complexity of the detecting system.

EP-A-200945262 of Applicant describes a method for detecting the stop of the yarn which, in lieu of dedicated breaking sensors, employs the signal generated by the loop count sensor already coupled to the feeder. With the above described method, the interval between the pulses generated by the loop count sensor is compared with a threshold interval which is continuously updated as a function of the changes of the yarn-drawing speed of the downstream machine. When the interval between two pulses exceeds the threshold interval, the system interprets the event as anomalous and stops the machine.

The method described in the above-cited prior document is suitable for those knitting lines in which the yarn is drawn continuously, i.e., the operation of the feeders is never interrupted while forming the pattern. When, on the contrary, the feeders have a discontinuous operation, i.e., they are subjected to stops and restarts, which are typically controlled by respective selectors driven by a cam associated to the rotor of the machine, the above-described method is not suitable because it is not capable of distinguishing any accidental stops from the controlled stops. Typically, knitting lines employing large-in-diameter, so-called "striper" machines, or small-in-diameter, so-called "seamless" machines, or machines for socks, have a discontinuous operation.

SUMMARY OF THE INVENTION

Therefore, it is a main object of the present invention to provide a method for detecting accidental stops of the yarn which does not employ dedicated sensors and may also be used in knitting lines in which the feeders have a discontinuous operation while forming the pattern, as well as an apparatus for carrying out the method.

The above object and other advantages, which will better appear from the following description, are achieved by the method and the apparatus having the features recited in claims 1 and 9 respectively, while the dependent claims state other advantageous, though secondary, features of the invention.

BRIEF DESCRIPTION OF THE DRAWINGS

The invention will be now described in more detail with reference to a preferred, non-exclusive embodiment, shown by way of non-limiting example in the attached drawings, wherein.

DESCRIPTION OF THE PREFERRED EMBODIMENTS

Figure 1:
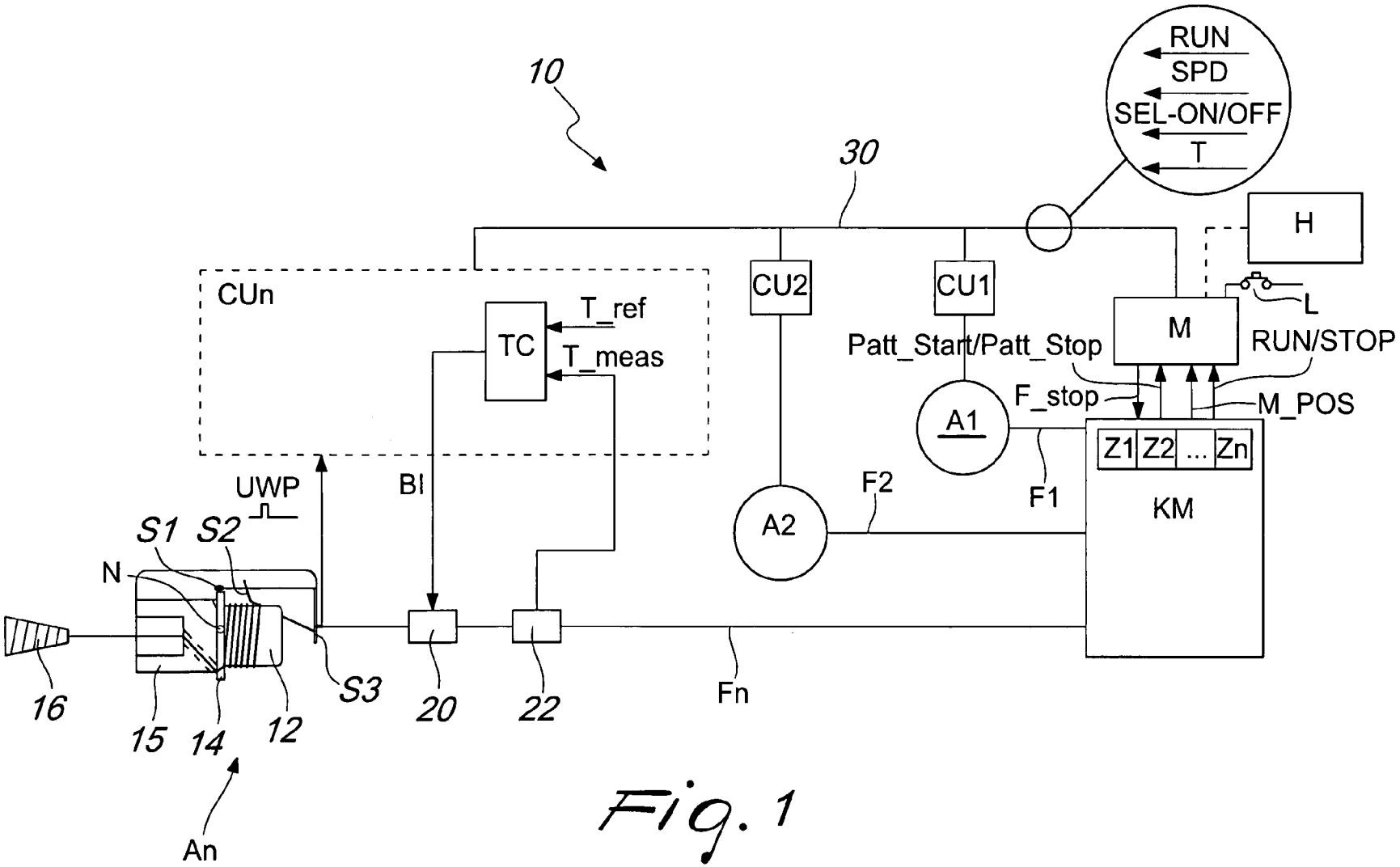
FIG. 1 is a block diagram showing a knitting line using the method according to the invention.

In FIG. 1, a knitting line 10 is shown which comprises a plurality of yarn feeders A1, A2, . . . , An, from which a downstream knitting machine KM draws respective yarns F1, F2, . . . , Fn. For the sake of clarity, only the block diagram of feeder An is shown in FIG. 1, but it is understood that all the feeders are identical. The feeders are provided with respective control units CU1, CU2, . . . , CUn which are subjected to signals transmitted on a serial bus 30 which is connected to machine KM via a master unit M. Feeders A1, A2, . . . , An are controlled by respective selectors Z1, Z2, . . . , Zn which in turn are conventionally driven by a cam coupled to the rotor of machine KM (not shown), whereby the state of selection of the individual feeders of the line changes as a function of the angular position of the rotor.

Each feeder comprises a stationary drum 12 and a flywheel 14 driven by a motor 15, which draws yarn F from a reel 16 and winds it on drum 12 in form of loops forming a weft stock. Upon request from knitting machine KM, the yarn is unwound from drum 12 and is fed to the machine.

The amount of yarn stored on drum 12 is controlled by a triad of sensors. A first sensor S1, typically a Hall sensor, is used to calculate the amount of yarn wound on the drum, as well as the winding speed, by detecting the passing of magnets such as N coupled to flywheel 14. A second sensor S2, preferably a mechanical sensor, provides a binary information indicative of the presence or absence of a minimum amount of stock on an intermediate area of drum 12. A third sensor S3, preferably an optical sensor, generates a pulse UWP per each loop unwound from the drum.

A weft-braking device 20 is arranged downstream of yarn-feeder An and is controlled by a control unit CU that is programmed to control the tension of the yarn unwinding from drum 12 in order to maintain it substantially constant. To this purpose, a tension sensor 22, which is arranged downstream of weft-braking device 20, measures the tension of yarn Fn unwinding from the drum and generates a corresponding measured tension signal T_meas. Of course, the weft-braking devices and the tension sensors of those feeders which are only represented by circular blocks in FIG. 1, are not shown but are to be intended as comprised in such blocks A1, A2, . . . , which identify the feeders. Control unit CUn comprises a control block TC which is programmed to compare measured tension signal T_meas with a reference tension T-ref representing a desired tension, and to generate a braking signal BI which drives weft-braking device 20 in such a way as to modulate the braking force in order to minimize the difference between the measured tension and the reference tension.

In order to detect any accidental stop of the yarn, the above-described apparatus employs a method which does not require dedicated sensors because it uses the pulse signals UWP generated by third sensor S3.

In particular, as mentioned above, during its normal operation the feeder receives a pulse UWP from sensor S3 per each loop unwound from drum 12. As well known to the person skilled in the art, the yarn-drawing speed is substantially constant at a certain operating speed of the downstream machine, so that these pulses are substantially equally-spaced over time, i.e., the time intervals between successive pulses may only vary of negligible amounts. Accordingly, the method according to the invention is based on the principle that, when the delay from the last pulse is considerably longer than the average time interval between two pulses, it means that the yarn has accidentally stopped, because the yarn has broken or unhooked from the needles of machine KM.

With the method according to the invention, master unit M transmits the following signals on bus 30, as shown in FIG. 1:

- a machine state signal RUN, which is derived from a corresponding signal RUN/STOP received by master unit M from machine KM, and is transmitted at least at each change of state, so that all the feeders interrupt the detection when machine KM is not operative, and restart the detection when machine KM is operative;
- a machine speed signal SPD, which is derived from a position signal M-POS received by master unit M from machine KM, and is transmitted at regular intervals, e.g., 50 ms;
- a feeder selection signal SEL_ON/OFF indicative of the state (selected/unselected) of the individual feeders as a function of the angular position of machine KM, which signal is used by the individual feeders for suspending the detection when they are not selected, as will be better described below; and
- a tuning enabling signal T, which is transmitted by the master unit for enabling a preliminary tuning operation for the feeders.

The preliminary tuning operation comprises the following steps:

- the machine is operated at a nominal operative speed SPD0 and the average time interval MUT0 between two successive pulses is calculated at this nominal operative speed SPD0,
- a nominal threshold time interval MWT0 is calculated according to the formula:

$$MWT0=MUT0*K,$$

wherein K is a constant preferably in the range 2 to 4, and

- nominal threshold interval MWT0 and nominal operative speed SPD0 of the machine are stored.

Once performed the above tuning operation, the method according to the invention, which is enabled only when machine KM is operative, comprises the following steps:

- feeder selection signal SEL_ON/OF indicative of the state of selection of the individual feeders as a function of the angular position of machine KM is periodically transmitted on the bus, and, for those feeders which are selected,
- a threshold time interval updated in real time is continuously calculated according to the formula:

$$MWT=MWT0*SPD0/SPD,$$

wherein MWT is the updated threshold interval and SPD is the machine speed updated in real time,

- delay DT from the last pulse UWP is continuously measured and compared with the updated threshold interval MWT,
- when delay DT exceeds the updated threshold interval MWT, the machine is stopped.

Average time interval MUT0 between two successive pulses at the nominal operative speed SPD0 is advantageously calculated as arithmetic mean of the last m intervals $UT_1$, $UT_2$, . . . , $UT_m$, wherein m is preferably in the range 3 to 5.

With the machine at rest, the value of SPD is equal to 0 and the control unit disables the detecting method; this circumstance corresponds to set threshold time interval MWT to infinity.

The average time interval between two successive pulses is only calculated during the tuning operation and the threshold time interval is directly updated as a function of the operative speed of the machine, from which the yarn-drawing speed depends.

Of course, the above-cited measuring/computing operations are performed by the control units of the selected feeders on the basis of the pulse signals received by loop count sensor S3. The programming of the control units falls within the normal knowledge of the person skilled in the art and, therefore, will not be further described.

If it is not possible to derive feeder selection signal SEL_ON/OFF directly from the machine, which signal, as mentioned, changes as a function of the angular position of the machine, the above-described method advantageously comprises a preliminary learning procedure, in which machine KM generates a sample pattern. While the sample pattern is generated, the changes of state of selection of the single feeders are stored in master unit M and are used in the following cycles to generate feeder selection signals SEL_ON/OFF, which are synchronized on the basis of position signal M_POS received by master unit M from machine KM.

As mentioned above, feeders A1, A2, . . . , An are controlled by respective selectors Z1, Z2, . . . , Zn which, in turn, are driven by a cam coupled to the rotor of machine KM.

Figure 2:
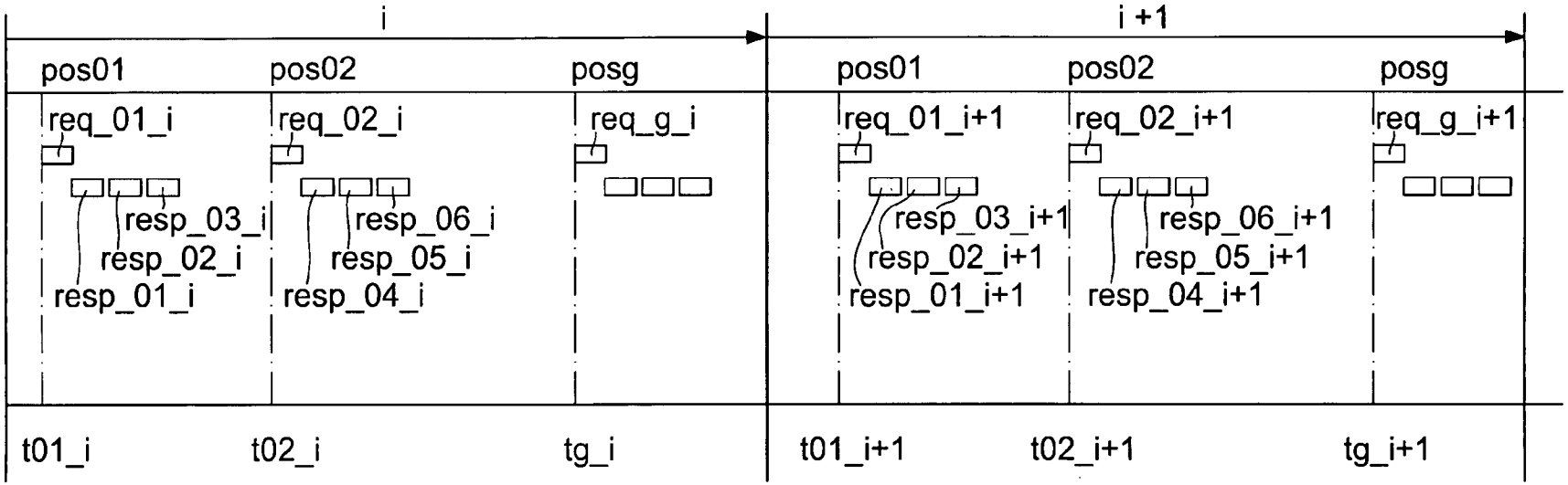
FIG. 2 is a diagram showing the exchange of signals over time during an accessory learning procedure belonging to the method according to the invention.

With reference to FIG. 2, a learning procedure will be now described by way of example, which can be used in the case of a number n of selectors splitted in a number g of groups each including three selectors.

At the beginning of the pattern, machine KM sends a signal Patt_start (FIG. 1) which starts the learning procedure. At the i-th revolution of the learning procedure (wherein i is a progressive index subsequent to signal Patt_start), as soon as position signal M_POS overcomes position pos1 corresponding to the first group, master unit M transmits a request message req_01_i to the three feeders of the first group, inquiring about the number of pulses detected by the respective loop count sensors S3 (FIG. 1). The three feeders transmit respective response messages resp_01_i, resp_02_i e resp_03_i to the master unit, containing the data about the number of detected pulses ns_01_i, ns_02_i e ns_03_i.

Once overcome angular position pos2, master unit M transmits a request message req_02_i to the next three feeders of the second group, and receives response messages resp_04_i, resp_05_i e resp_06_i containing the data about the number of detected pulses ns_04_i, ns_05_i e ns_06_i.

The above operations are then repeated until the last, g-th group (position posg, request req_g_i, etc.).

During the next revolution i+1, master unit M repeats the same operations and compares the number of loops unwound from each feeder up to the current revolution, i+1, with the number of loops unwound up to the previous revolution, i. The state of selection of the c-th feeder is evaluated on the basis that, if ns_c_i+1>ns_c_i, than the c-th feeder has been selected during the i-th revolution, otherwise, it has not been selected.

This procedure continues until machine KM generates a signal Patt_stop (FIG. 1) which stops the learning procedure.

As mentioned above, the selection data stored in master unit M are used during the normal operation of the machine to generate feeder selection signals SEL_ON/OFF, which are synchronized on the basis of the angular position signal M_POS that master module M receives from machine KM.

Each feeder, during the learning procedure, advantageously also calculates the average yarn-unwinding speed.

To this purpose, e.g., with reference to the first feeder, the number of pulses at revolution i+1, ns_01_i+1, is compared with the number of pulses at the previous revolution i, ns_01_i, and if the former is higher than the latter (i.e., during that revolution a consumption of yarn has occurred), the average loop unwinding time is calculated as $$Tm=(ns_01_i+1-ns_01_i)/(t01_i+1-t01_i),$$

wherein t01_i is the time instant when request message req_01_i inquiring about the number of loops unwound from the first feeder at the i-th revolution is received, and t01_i+1 is the time instant when request message req_01_i+1 inquiring about the number of loops unwound from the first feeder at the i+1-th revolution is received.

Alternatively, in order to further reduce the risks of false measurements, the feeder could calculate the average time over a number of revolutions in which it is selected.

Figure 3:
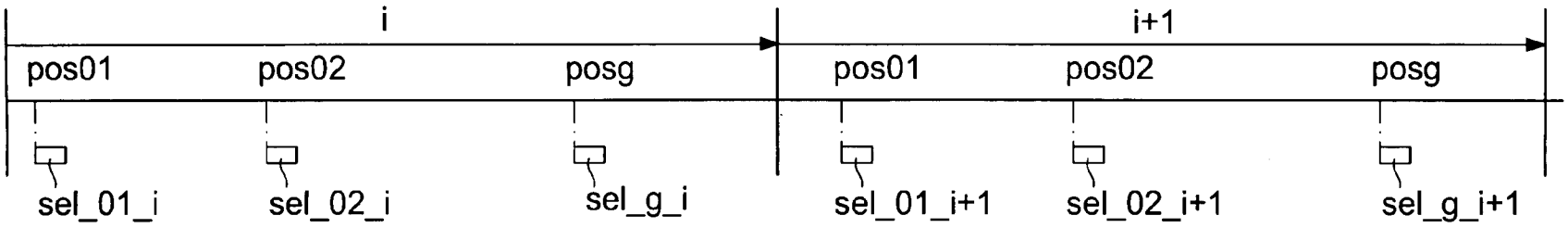
FIG. 3 is a diagram showing the exchange of signals over time while carrying out the method according to the invention.

The sequence of messages transmitted on the bus during the normal operation of the machine is shown in FIG. 3. During the i-th revolution, once reached position post, master unit M sends message sel_01_i containing the data of selection of the three feeders of the first group; once reached position pos2, it sends message sel_02_i concerning the second group, etc.

As shown in FIG. 1, a terminal H is connectable to master unit M for the setup of the system (e.g., number of points of the position signal, machine angular positions corresponding to the feeders, and the like). Terminal H can also be used to check the process variables of feeders A1, A2, . . . , An via the bus, as well as to modify operative parameters of the feeder. Once completed the setup of the system, the terminal can be disconnected and a push button L can be used as the sole input to the system for starting the learning procedure.

A few preferred embodiments of the invention have been described herein, but of course many changes may be made by a person skilled in the art within the scope of the claims. In particular, although only one sensor S3 is present in the above-described preferred embodiments, whereby only one pulse is generated per each loop unwound from the drum, the invention is similarly applicable in the case that a plurality of equally-spaced sensors are provided, whereby a plurality of pulses are generated per each loop unwound from the drum.

The disclosures in EPA 10425268.9 from which this application claims priority are incorporated herein by reference.

What is claimed is:

1. A method for detecting the stop of the yarn in knitting lines provided with a plurality of yarn feeders from which a downstream machine draws respective yarns, said machine being provided with selection means adapted to vary the state of selection of said yarn feeders in relation to the angular position of the machine, and each of said yarn feeders being provided with a stationary drum and with a yarn count sensor arranged to generate a pulse per each yarn loop unwound from the drum, wherein it comprises the steps of:

periodically sending a selection signal to said yarn feeders, which is indicative of the state of selection of the individual feeders in relation to the angular position of the machine and, for each of the selected feeders, continuously calculating a threshold time interval corresponding to the maximum interval between two successive pulses, above which it should be regarded that an accidental stop of the yarn has occurred, said threshold time interval being updated in real time as a function of the yarn-drawing speed, continuously measuring the delay from the last pulse and comparing it with said updated threshold time interval, and stopping said downstream machine when said measured delay exceeds said updated threshold interval.

2. The method of claim 1, comprising a preliminary learning procedure, in which said machine generates a sample pattern and the changes in the state of selection of said feeders in relation to the angular position of the machine, during the generation of said sample pattern, are stored in order to be successively used to generate said selection signal.

3. The method of claim 2, wherein said preliminary learning procedure includes comparing, at each revolution, the number of loops unwound from each feeder up to the current revolution with the number of loops unwound up to the previous revolution, and those feeders are memorized as selected which satisfies the condition $$ns_c_i+1>ns_c_i,$$

wherein ns_c_i and ns_c_i+1 are the number of loops respectively unwound from the feeder up to said previous revolution and said current revolution.

4. The method of claim 3, wherein said selection means comprise a plurality of selectors splitted in groups, each of said selectors being coupled to a respective feeder, wherein, at each revolution, the data of the number of loops from the feeders of each group are provided in response to a request message generated as soon as the machine overcomes the position corresponding to the respective group.

5. The method of claim 1, comprising a preliminary tuning operation comprising the following steps:

operating the machine at a nominal operative speed and calculating the average time interval between two successive pulses at said nominal operative speed, calculating a nominal threshold time interval according to the formula:

$$MWT0=MUT0*K,$$

wherein MWT0 is said nominal threshold time interval, MUT0 is said average time interval between two successive pulses at the nominal speed, and K is a predetermined constant, and wherein said threshold time interval is calculated according to the formula:

$$MWT=MWT0*SPD0/SPD$$

wherein MWT is the calculated threshold time interval, SPD0 is said nominal operative speed, and SPD is the operative speed updated in real time.

6. The method of claim 5, wherein said constant is in the range 2 to 4.

7. The method of claim 5, wherein said average time interval between two successive pulses at said nominal speed is calculated as arithmetic mean of the last m intervals.

8. The method of claim 7, wherein m is in the range 2 to 5.

9. An apparatus for detecting the stop of the yarn in knitting lines comprising a plurality of yarn feeders from which a downstream machine draws respective yarns, said machine being provided with selection means adapted to change the state of selection of said yarn feeders in relation to the angular position of the machine, and each of said yarn feeders being provided with a stationary drum and with a yarn-count sensor arranged to generate a pulse per each yarn loop unwound from the drum, comprising a master unit programmed to periodically send a selection signal to said feeders, which indicates the state of selection of the single feeders in relation to the angular position of the machine, and wherein each of said feeders is provided with a respective control unit which, in response to said selection signal, is programmed to continuously calculating a threshold time interval corresponding to the maximum interval between two successive pulses, above which it should be regarded that an accidental stop of the yarn has occurred, said threshold time interval being updated in real time as a function of the yarn-drawing speed, continuously measuring the delay from the last pulse and comparing it with said updated threshold time interval, and stopping said downstream machine when said measured delay exceeds said updated threshold interval.

* * * * *